US012209516B2

(12) United States Patent
Matthias et al.

(10) Patent No.: US 12,209,516 B2
(45) Date of Patent: Jan. 28, 2025

(54) ARMORED POPPET VALVE AND METHOD FOR THE PRODUCTION THEREOF

(71) Applicant: FEDERAL-MOGUL VALVETRAIN GMBH, Barsinghausen (DE)

(72) Inventors: Thorsten Matthias, Garbsen (DE); Stefan Kellermann, Barsinghausen (DE)

(73) Assignee: FEDERAL-MOGUL VALVETRAIN GMBH, Barsinghausen (DE)

( * ) Notice: Subject to any disclaimer, the term of this patent is extended or adjusted under 35 U.S.C. 154(b) by 0 days.

(21) Appl. No.: 18/551,102

(22) PCT Filed: Feb. 22, 2022

(86) PCT No.: PCT/EP2022/054310
§ 371 (c)(1),
(2) Date: Sep. 18, 2023

(87) PCT Pub. No.: WO2022/194495
PCT Pub. Date: Sep. 22, 2022

(65) Prior Publication Data

US 2024/0159173 A1 May 16, 2024

(30) Foreign Application Priority Data

Mar. 18, 2021 (DE) ..... 102021106647.6

(51) Int. Cl.
*F01L 3/04* (2006.01)

(52) U.S. Cl.
CPC ..... *F01L 3/04* (2013.01); *F01L 2303/01* (2020.05)

(58) Field of Classification Search
CPC ..... F01L 3/04; F01L 2303/01
See application file for complete search history.

(56) References Cited

U.S. PATENT DOCUMENTS 3,319,321 A 5/1967 Danis

FOREIGN PATENT DOCUMENTS

| | | | | |
|---|---|---|---|---|
| DE | 3205183 A1 | | 8/1983 | |
| DE | 3614185 A1 | | 2/1987 | |
| DE | 102008037747 A1 | | 2/2010 | |
| DE | 102016122514 B4 | | 6/2019 | |
| JP | 2009185655 A | * | 8/2009 | ..... B21D 22/16 |

* cited by examiner

*Primary Examiner* — Kevin A Lathers
(74) *Attorney, Agent, or Firm* — Dickinson Wright PLLC

(57) ABSTRACT

A method for the production of a poppet valve which is armoured in at least the region of a valve seat, comprising providing a substantially cylindrical or cup-shaped semi-finished product produced from a valve steel, which is coated with an armouring material, whereupon the coated semi-finished product is formed into an armoured poppet valve.

15 Claims, 4 Drawing Sheets

ARMORED POPPET VALVE AND METHOD FOR THE PRODUCTION THEREOF

BACKGROUND

1. Technical Field

The present invention relates to a novel method for the production of an armoured poppet valve, as well as to a poppet valve produced by the method.

2. Related Art

The armouring of a valve seat, or a part of a poppet valve which comes into contact with the valve seat in a cylinder head, is the portion of a valve which comes under the highest load. The sealing surface in this case must accommodate both the moving forces upon opening and closing every other stroke and additionally guide the force produced during the combustion process into the cylinder head. Considerable forces arise in the region of the valve seat as a function of the rotational speed and selected combustion pressures.

Any type of internal stress which is introduced into the material by armouring in this region could lead to the formation of cracks there, and therefore to a failure of the valve and thus of the engine as a whole.

Until now, various approaches have been taken in order to apply armouring to a valve seat surface. Most of those methods, however, suffer from the disadvantage that they are carried out with a heat treatment on a valve which is finished to a greater or lesser extent, after the valve is already in its final form. These heat treatments can lead to stresses in the material.

SUMMARY

It would thus be desirable to provide a method which enabled a poppet valve to be produced with an armoured valve seat in which no final heat treatment or coating was necessary.

In accordance with a first aspect of the present invention, a method for the production of an armoured poppet valve which is armoured in at least the region of the valve seat is provided. In this regard, the method comprises providing a substantially cylindrical semi-finished product produced from a valve steel, wherein then, a portion of the substantially cylindrical semi-finished product is coated with an armouring material and finally, the coated semi-finished product is formed into an armoured poppet valve.

The basic shape of the substantially cylindrical semi-finished product is simply a steel rod or round bar produced from valve steel. In a next step, a portion of the semi-finished product is coated with an armouring material and formed into an armoured poppet valve. The skill and creativity involved with this method is that the coating is applied without any prior treatment of a piece of round steel, and in fact in a manner such that after all of the subsequent forming steps, the coating comes into a position where it is subsequently intended to be located, i.e. at the valve seat or the entire valve head. In this regard, it is particularly important to select the thickness and the position or the distribution of the coating in a manner such that during the subsequent forming steps, the coating migrates to or remains at the location where a valve head or a valve seat will subsequently be formed. The semi-finished product may also have substantially the basic shape of a flat cylinder, i.e. a disk.

In accordance with a second aspect of the present invention, a method for the production of a poppet valve which is armoured in at least the region of a valve seat is provided. In this regard, the method comprises providing a substantially cup-shaped semi-finished product produced from a valve steel, wherein then, a portion of the substantially cup-shaped semi-finished product is coated with an armouring material and finally, the coated semi-finished product is formed into an armoured poppet valve.

Here again, the starting point is an only lightly treated semi-finished product which in a preceding step is formed by pressing or extruding a piece of round steel into a substantially cup-shaped semi-finished product produced from valve steel. In the next steps, a portion of the semi-finished product is coated with an armouring material and then formed into an armoured poppet valve. Here again, the inventive contribution is that the coating is applied to a cup-shaped piece of steel without any previous specific treatment thereof, and in fact in a manner such that after all of the subsequent forming steps, the coating comes into a position where it is subsequently intended to be located, i.e. at the valve seat or the entire valve head. In this regard, preferably, the thickness and the position or the distribution of the coating should be selected in a manner such that during the following forming steps, the coating migrates to or remains where a valve head or a valve seat will subsequently be formed. To this end, the present invention may require several tests until it is clear at what position and how wide and at what thickness the coating has to be applied in order to obtain an ideal result. In this regard, only a few test runs should be necessary, because the displacement behaviour of the armouring material is quasi-linear.

In a further embodiment of the invention, the substantially cylindrical or substantially cup-shaped semi-finished product is coated in a circular shape. In doing so, the coating essentially forms a circular ring which can be applied to an end surface. It is also possible to apply the circular ring to a curved surface. In this regard, the coating should be applied substantially rotationally symmetrically to a rotationally symmetrical axis of the substantially cylindrical or cup-shaped semi-finished product. It is also possible to apply the coating to both an end surface and also to a curved surface, wherein in this case, the coating is disposed around an edge between the end surface and the curved surface.

In another embodiment of the method, the substantially cylindrical or cup-shaped semi-finished product is coated on an end surface in the form of a circle or a circular ring. This embodiment means that a disk-shaped blank can be coated, from which a hollow valve can be formed by extrusion, deep drawing or backward extrusion. In this regard, an armoured valve seat can be produced with the circular ring and a completely armoured valve disk can be produced with the circle or with the circular surface.

In an additional embodiment of the method, a cup-shaped coating is applied to the substantially cylindrical or cup-shaped semi-finished product. In this regard, an end surface is completely coated and an adjoining portion of a curved surface is also coated. In this case, the coating extends over only a small part of the length of the semi-finished product. This type of coating also serves for the production of valves with a completely coated valve head.

In a further exemplary embodiment of the method, the cylindrical or cup-shaped semi-finished product with a cup-shaped coating is formed in a manner such that in the finished valve, the coating armours a valve disk surface and a valve seat of the poppet valve. In this regard, the coating should be selected in a manner such that after forming, it also covers at least the portion of the poppet valve which faces the combustion chamber and the valve seat.

In an additional embodiment of the method, the cylindrical or cup-shaped semi-finished product coated with a cup-shaped coating is formed in a manner such that a valve head, including a valve disk surface and a valve seat, is armoured. Here, in the finished valve, the armour also extends over the rear side of the valve or the transition between the valve and the valve stem. This embodiment facilitates the production of a valve which is also armoured on a rear side of the poppet valve.

In another embodiment of the invention, the substantially cylindrical or cup-shaped semi-finished product is coated by surface cladding, friction surfacing, thermal spraying, powder metallurgical material application, selective laser melting, i.e. by a laser application process, by the application of powdered metal and/or by plasma-powder surface cladding.

In the present method, different types of valve steels may be selected for the production of the valves. Austenitic valve steels may be selected, wherein the steel grades 1.4882 and 21871 are preferred. It is also possible to use martensitic valve steels for the production of the valve head, wherein the steel grade 1.4718 is preferred. Nickel-based alloys may also be used as the material for the valve head, preferably Nimonic® 80A, for example. These materials are suitable as starting materials for the semi-finished product or for the cup-shaped semi-finished product.

In accordance with an exemplary embodiment of the method, the valve steel may be selected from the group consisting of:

X45CrSi9-3, 1.4718/Sill:
X85CrmoV13-02, 1.4748/Cromo 193:
X53CrMnNi21-09, 1.4871/21-4N;
X50CrMnNiNbN21-09, 1.4882/21-43:
X30CrMnNiNbV25-12, 25-12NbN:
NFC 3015, 3015D
Ni36,
Ni80A:
NiCr20TiAl 2.4352, as well as 1541, 1038, 4140, A193, 21-2N, 21-4N, Resistel, Pyromet 31V and Inocel 751. These materials are particularly suitable as basic materials for use as an applied armouring material. All of the materials given may also include unavoidable impurities.

In accordance with an exemplary embodiment of the method, the armouring material which is selected may be a chromium-based or nickel-based powder. The selection of T400, for example, is also envisaged and preferred as the armouring material, or more preferably Stellite® 6.

In accordance with an exemplary embodiment of the invention, the armouring material may be selected from the group consisting of:

CoCr26Ni22W,
CoCr30W,
CoCr28W, or
Ni90: Ni90 is an alloy which consists of 90% by weight nickel and 10% by weight chromium. All of the materials given may also include unavoidable impurities.

In accordance with a further embodiment, the armouring material is selected from the group comprising:

Stellite #1, Stellite #6/P58, P37, P27, P25, P65, P39, P40, P82, RC52.

In a further embodiment, the substantially cylindrical semi-finished product coated with the armouring material is formed into a substantially cup-shaped preform. This forming may be carried out by extrusion, backward extrusion, drop forging or deep drawing. Here, either a mandrel is driven into the cylinder with an appropriate forging die, or the cylindrical semi-finished product is formed in a different manner so that it is suitable as a hollow part for forming a hollow valve.

In a further embodiment of the method for the production of an armoured poppet valve, forming of the substantially cylindrical semi-finished product or of the cup-shaped preform coated with the armouring material into a poppet valve comprises forging, drop forging, upsetting, extrusion, drawing, reducing and rolling, preferably flow forming or preferably transverse rolling and/or cold stamping.

In particular, a process for upsetting an axially symmetrical forged part in a forging die in a plurality of forming steps is preferred. Prior to forming in this regard, at least a portion of the workpiece is heated in a furnace, for example an induction furnace, to the forging temperature.

Furthermore, a cavity may be produced in the valve by forming by means of drop forging, upsetting, extrusion, drawing and reducing, as well as by flow forming.

In a further embodiment of the method, it furthermore comprises the production of a cavity in at least the valve stem and/or in the valve head by drilling, milling, turning, spark erosion and/or electrochemical machining.

In this embodiment, a valve is hollowed out or a cavity in the valve is worked further in order to enlarge it or smooth it.

In an additional embodiment of the method, it further comprises filling the cavity in the valve with sodium, followed by sealing the cavity. This may be carried out by rolling down the end of a stem or by sealing the stem end, for example by friction welding. Filling with sodium is preferably carried out under a protective atmosphere and sealing of the cavity is preferably carried out under reduced pressure or under vacuum.

In accordance with a further aspect of the present invention, a poppet valve is provided which has been produced with the method described above.

THE DRAWINGS

The present invention will be illustrated below with the aid of diagrammatic figures which are not to scale.

DETAILED DESCRIPTION

Figure 1A:
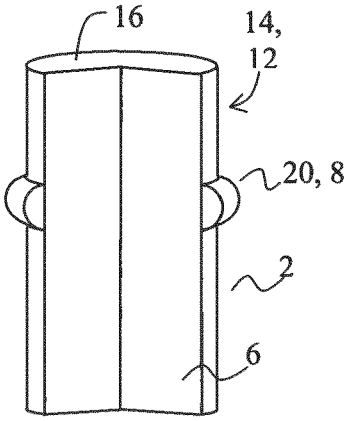
FIGS. 1A to 1C show a first embodiment of a method for the production of a valve armoured at the valve seat.

Identical or similar reference numerals will be used in the description and the figures below to refer to identical or similar elements or components.

FIG. 1A shows a substantially cylindrical semi-finished product 2 produced from valve steel 6 which is provided with a circular coating 20 produced from an armouring material on a curved surface of the semi-finished product 2. The armouring material may be applied to the curved surface using different application methods. An essential advantage is that the semi-finished product does not have to be treated beforehand in order, for example, to introduce a groove or the like into the blank. It may be advantageous to clean or prepare the surface prior to coating in order to obtain good adhesion between the armouring material and the valve steel.

Figure 1B:
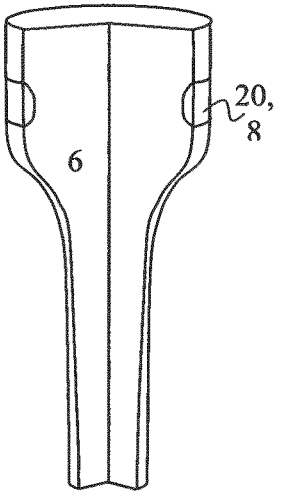

In FIG. 1B, the blank is formed by upsetting the head and/or by reducing the stem to produce a preform. The armouring material 20 still forms a circular ring on a curved surface of a part from which the valve head will subsequently be formed. The raised applied armouring material 20 in FIG. 1 has been flattened during the upsetting and pressed into the preform produced from valve steel. In this forming procedure, the armouring material 8 is forge welded with the valve steel 6, whereupon a secure bond is obtained between the valve steel 6 and the armouring material 8.

Figure 1C:
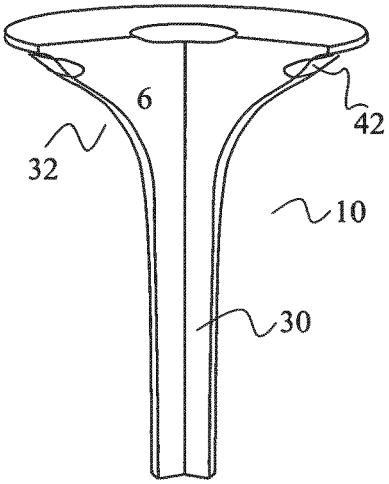

FIG. 1C shows a finished formed valve (wherein only an end of the valve stem is not shown). The finished valve can be formed from the preform of FIG. 1B by means of multi-stage forming in a plurality of drop forging dies. The valve is configured as a solid valve. The position and the shape of the armouring at the valve seat 42 can be influenced by the location and form of the application of the armouring material in FIG. 1A. However, this can be ascertained by various simulation processes and a few experiments. As an example, a blank or a semi-finished product produced from a layered material such as Damascus steel may be produced which, in combination with a multi-coloured coating material, can provide information even during the production of a single valve regarding how a steel behaves upon drop forging and where and how the armouring material should be applied to the blank. Here, with a few simulation or forging test steps, separate machining or forging treatment of the blank could be dispensed with. Furthermore, this method has the advantage that the armouring material 8 is forge welded at every forming procedure with the valve steel 6. Because hot forming is envisaged here, then no crack formation occurs in the armouring material 8 upon forming.

FIGS. 2A to 2D show the principle of a similar method to that of FIG. 1A to 1C, the difference being that an essentially cup-shaped semi-finished product 4 is employed. Furthermore, the armouring material 8 is applied on the top to an end 16 of the substantially cup-shaped semi-finished product 4 and forms a circular coating on the end surface there. In a first step, the substantially cup-shaped semi-finished product 4 is drawn or deep drawn.

Figure 2A:
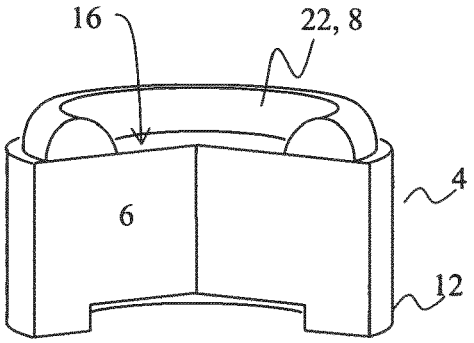
FIGS. 2A to 2D show a further method for the production of a hollow valve armoured at the valve seat.
Figure 2B:
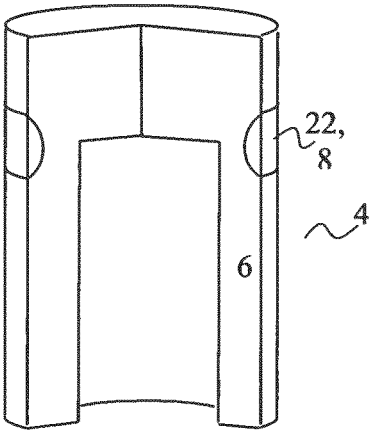
Figure 2C:
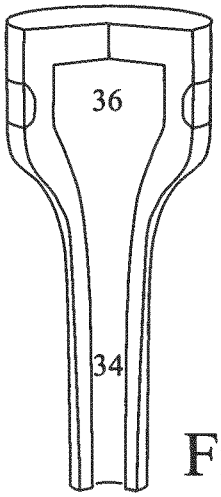

FIG. 2B shows the result of deep drawing the component of FIG. 1. By deep drawing, the coating on the end surface has been displaced onto a curved surface and now the cup-shaped character of the part can clearly be seen. In a further step, this component is upset and/or reduced onto a posterior stem, as can be seen in FIG. 2C. This can be obtained by upsetting and transverse rolling or reducing. The cavity of the substantially cup-shaped semi-finished product can now be divided into a portion which can be associated with a valve head 36 and a portion which can be associated with a valve stem 34.

Figure 2D:
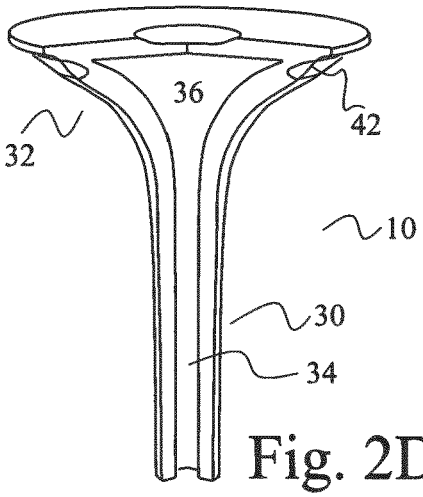

FIG. 2D shows the finished hollow valve, in which the valve head is completely formed, the armouring of the valve seat is in the correct position and the cavity of the valve comprises a cavity in the valve head 36 and a cavity in the valve stem 34. Here, it may be necessary during forging to fill the valve with a material which can subsequently be melted out in order to prevent the cavity from being crushed during forging. The valve may now also be filled with sodium and sealed at one end of the valve stem.

Figure 3A:
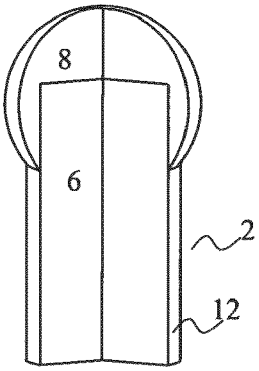
FIGS. 3A to 3C show a further method for the production of a valve armoured at the valve head.
Figure 3B:
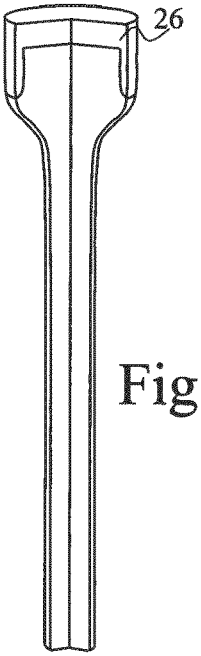
Figure 3C:
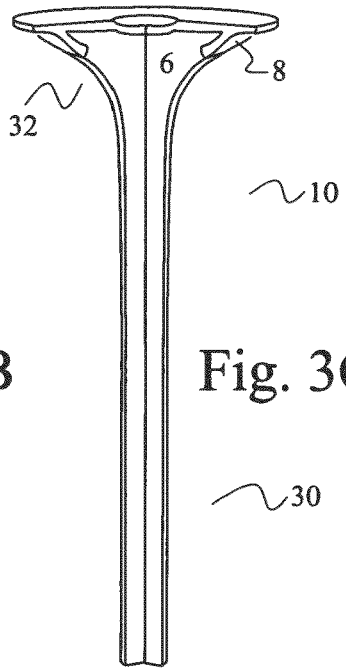

FIGS. 3A to 3C show a further method for the production of a valve armoured at the valve head. Here, FIG. 3A shows a substantially cylindrical semi-finished product 2 produced from a valve steel 6. An upper end of the semi-finished product 2 is coated with an armouring material 8. In this regard, the coating is substantially cup-shaped, 26, and extends over the entire end surface as well as a portion of the curved surface of the semi-finished product 2. This illustration shows that in particular, the coating does not have to have a uniform thickness overall. The local thickness of the coating may be varied in order to obtain a desired thickness of the armouring material in the finished valve. Here, any method for coating may be selected. As an example, an incandescent semi-finished product may be dipped in a metal powder with a binder in order to melt particles of an armouring material or of the binder onto it and bond with the semi-finished product.

The subsequent steps in FIGS. 3B and 3C correspond to those of FIGS. 1B and 1C, wherein the coating or the armouring material 8 in the finished valve not only extends at the valve seat, but also covers the entire valve head and in particular the valve disk surface.

Figure 4A:
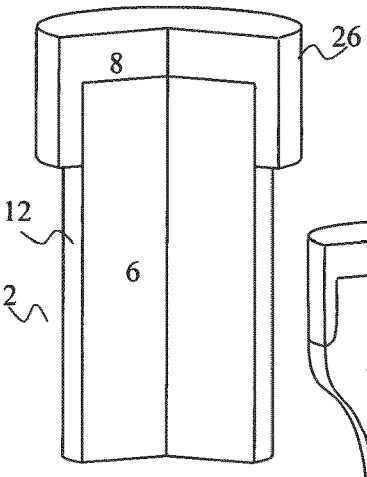
FIGS. 4A to 4D show a further method for the production of a valve armoured at the valve head which is subsequently hollowed out.
Figure 4C:
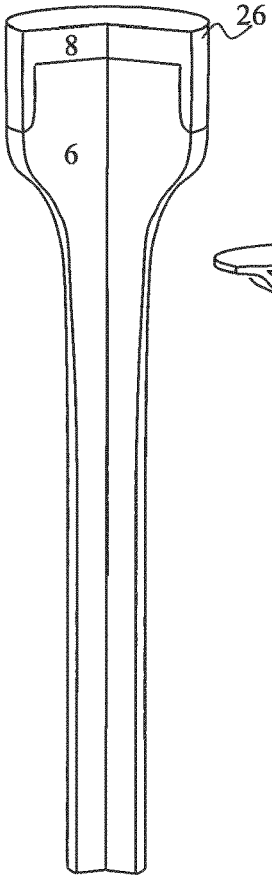
Figure 4D:
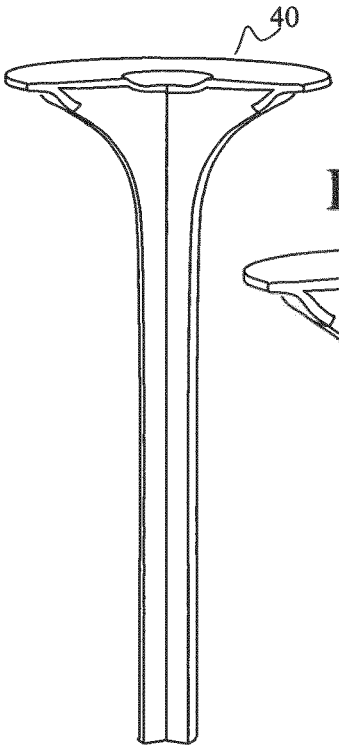
Figure 4B:
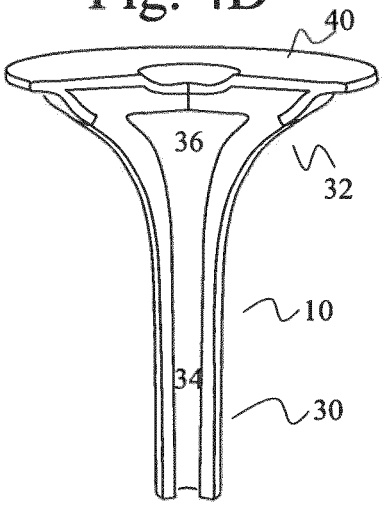

FIGS. 4A to 4D show a method which is largely identical to that of FIGS. 3A to 3C. In contrast to FIG. 3A, in FIG. 4A, the coating has a largely uniform thickness. The external shape of the coating is essentially a combination of an even coating of the end surface and a uniform coating of a portion of the curved surface of the cylindrical semi-finished product 2. FIGS. 4B and 4C respectively correspond to FIGS. 3B and 3C. In FIG. 4D, the valve of FIG. 4C is shown, wherein in an additional step, the stem has been hollowed out by drilling or turning. A cavity 36 has now been produced in the valve head by electrochemical machining. Now, the valve can be filled with sodium as a coolant and then sealed.

Figure 5A:
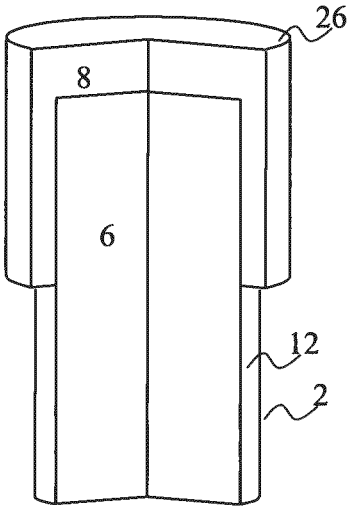
FIGS. 5A to 5D show a further method for the production of a valve armoured at the valve head.
Figure 5B:
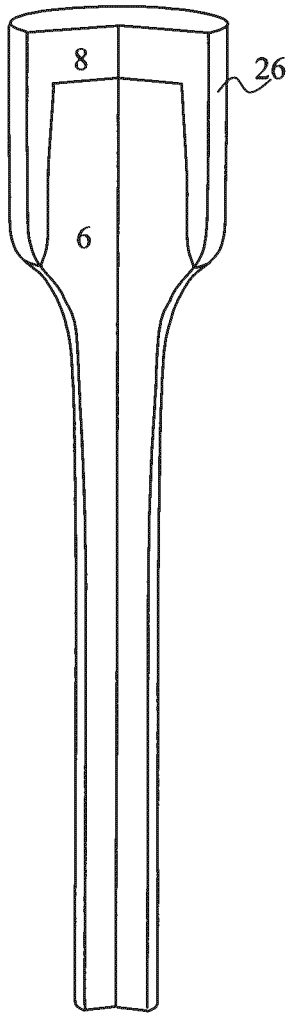
Figure 5C:
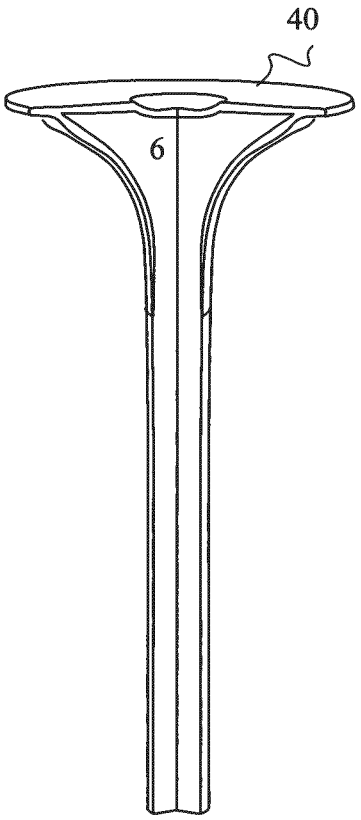
Figure 5D:
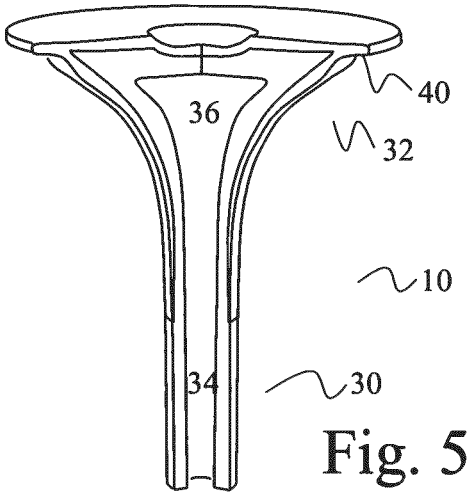

FIGS. 5A to 5D show a method which is largely identical to that of FIGS. 4A to 4D. In contrast to FIG. 4A, the coating of FIG. 5A has a largely uniform thickness. In contrast to FIG. 4A, the coating extends much further along the curved surface of the semi-finished product 2 produced from valve steel 6. The external shape of the coating is essentially a combination of an even coating of the end surface and a uniform coating of a portion of the curved surface of the cylindrical semi-finished product 2, wherein the coating extends much further in the axial direction. FIGS. 5B and 5C respectively correspond to FIGS. 4B and 4C, wherein here again, the coating extends much further in the axial direction. The coating here extends not only in the region of the valve seat, but also over the entire valve head to the valve stem. FIG. 5D shows the valve of FIG. 5C, wherein in an additional step, the stem has been hollowed out by drilling or turning. A cavity 36 has now been produced in the valve head, for example by electrochemical machining. The valve can also be filled with sodium as a coolant and then sealed.

Figure 6A:
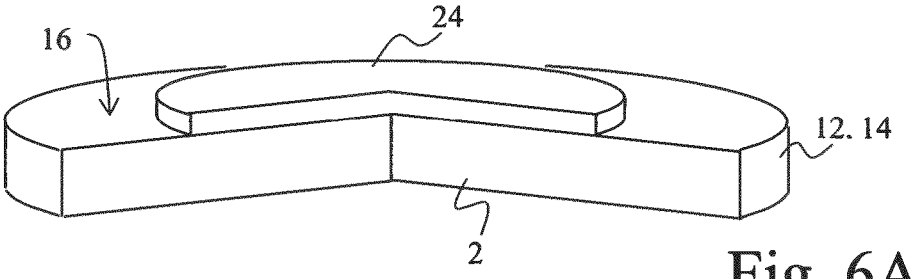
Figure 6B:
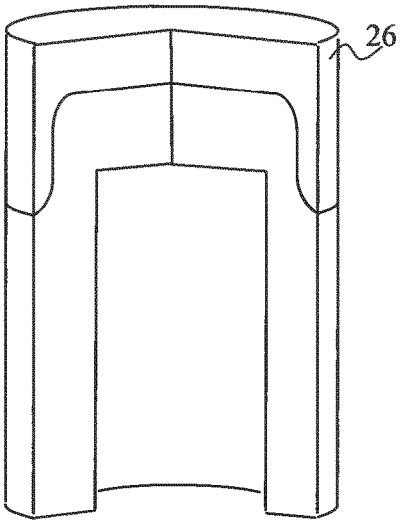
Figure 6C:
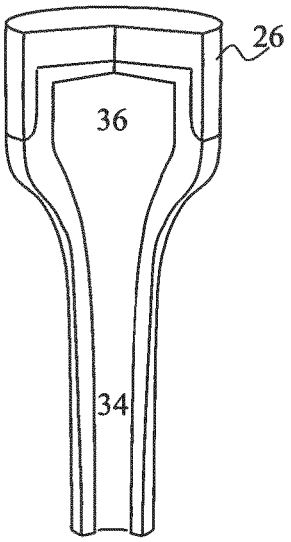
Figure 6D:
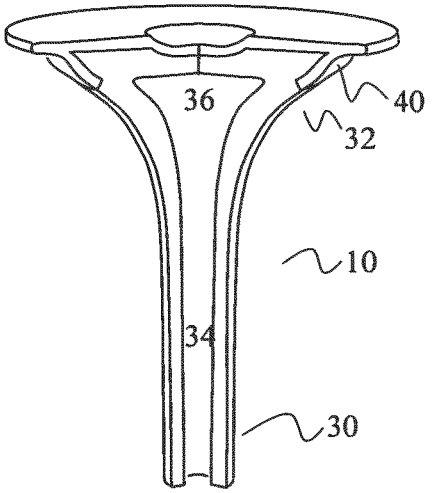

FIGS. 6A to 6D show a further method for the production of a valve armoured at the valve head. Here, the starting point is a cylindrical semi-finished product 2 which essentially forms a disk. An essentially disk-shaped coating has also been applied to the disk. FIG. 6B shows a hollow body which has been formed from the disk or roundel of FIG. 6A by deep drawing. Like the disk, the disk-shaped or circular coating has been formed into a substantially cup-shaped coating 26 produced from armouring material. The further steps which are shown in FIGS. 6C and 6D correspond to the article which is shown in FIGS. 2C and 2D, the difference here being that the entire valve head, and in particular the poppet valve surface, has been coated. The cavity of the valve of FIG. 6D is now filled with sodium and the cavity can then be sealed at one end of the valve stem.

This enables a poppet valve to be produced primarily by hot forming, whereupon an irregular thermal load on the valve disk during coating with an armouring material can be avoided. The armouring material is bonded to the valve steel by means of the forming steps, in particular by drop forging.

What is claimed is:

1. A method of manufacturing a poppet valve which is armored in at least a region of a valve seat, comprising:

providing a cylindrical or cup-shaped semi-finished product produced from a valve steel, coating a portion of the cylindrical or cup-shaped semi-finished product with an armoring material, forming the cylindrical semi-finished product coated with the armoring material into a cup-shaped preform, and forming the coated semi-finished product into an armored poppet valve.

2. The method of manufacturing a poppet valve according to claim 1, wherein the cylindrical or cup-shaped semi-finished product is coated in a circular shape or the cylindrical or cup-shaped semi-finished product is in the form of a circular ring along a curved surface.

3. The method of manufacturing a poppet valve according to claim 1, wherein the cylindrical or cup-shaped semi-finished product is coated on an end surface in the form of a circle or a circular ring.

4. The method of manufacturing a poppet valve according to claim 1, wherein the cylindrical or cup-shaped semi-finished product is coated in the shape of a cup, comprising a coating at an end surface and at an adjoining portion of a curved surface.

5. The method of manufacturing a poppet valve according to claim 4, wherein the cup-shaped coating of the cylindrical or cup-shaped semi-finished product is formed that a valve disk surface and a valve seat of the poppet valve are armored.

6. The method of manufacturing a poppet valve according to claim 1, wherein the cup-shaped coating of the cylindrical or cup-shaped semi-finished product is formed in a manner such that a valve head including a valve disk surface and a valve seat is armored.

7. The method of manufacturing a poppet valve according to claim 1, wherein the cylindrical or cup-shaped semi-finished product is coated by plasma-powder surface cladding, friction surfacing, thermal spraying, powder metallurgical material application, selective laser melting, laser application processes, or metallic powder application with the armoring material.

8. The method of manufacturing a poppet valve according to claim 1, wherein the valve steel is selected from the group consisting of: austenitic valve steels, martensitic valve steels, and/or a nickel-based alloy.

9. The method for manufacturing a poppet valve according to claim 8, wherein the valve steel is selected from a group consisting of:

X45CrSi9-3, 1.4718;
X85CrmoV13-02, 1.4748;
X53CrMnNi21-09, 1.4882, 21-4N;
X50CrMnNiNbN21-09, 1.4882, 21-43;
X30CrMnNiNbV25-12, 25-12NbN;
NFC 3015, 3015D;
Ni36, Ni80A; and
NiCr20TiAl, 2.4352.

10. The method of manufacturing a poppet valve according to claim 1, wherein the armoring material consists of chromium or nickel-based powder or T400 or Stellite® 6.

11. The method of manufacturing a poppet valve according to claim 1, wherein the armoring material is selected from the group consisting of:

CoCr26Ni22W,
CoCr30W,
CoCr28W, or
Ni90, an alloy produced from 90% by weight nickel and 10% by weight chromium.

12. The method of manufacturing a poppet valve according to claim 1, wherein forming of the substantially cylindrical or cup-shaped semi-finished product or of the cup-shaped preform coated with the armouring material into a poppet valve comprises at least one of the following steps:

forging,
drop forging,
upsetting,
extrusion,
drawing,
reducing, and
rolling,
flow forming,
transverse rolling, and
cold stamping.

13. The method of manufacturing a poppet according to claim 1, further comprising producing a cavity in at least the valve stem and/or in the valve head by drilling, milling, turning, spark erosion, or electrochemical machining.

14. The method of manufacturing a poppet valve according to claim 1, further comprising:

filling the cavity in the valve with sodium and
sealing the cavity.

15. An armoured poppet valve produced by a method as claimed in claim 1.

* * * * *